United States Patent [19]

Wirz et al.

[11] 4,000,692

[45] Jan. 4, 1977

[54] THROW-OFF SYSTEM FOR ROTARY OFFSET PRINTING PRESS

[75] Inventors: Burkhardt Wirz; Peter Decker, both of Munich; Valentin Gensheimer, Mulheim (Main); Alfred Dorn, Offenbach (Main), all of Germany

[73] Assignee: Roland Offsetmaschinenfabrik Faber & Schleicher AG., Germany

[22] Filed: Dec. 1, 1975

[21] Appl. No.: 636,375

[30] Foreign Application Priority Data

Dec. 3, 1974 Germany ..... 2456985

[52] U.S. Cl. ..... 101/144; 101/148; 101/352; 101/218

[51] Int. Cl.² ..... B41F 7/06; B41F 7/40; B41F 13/28; B41F 31/30

[58] Field of Search ..... 101/148, 349, 350, 351, 101/352, 363, 364, 137, 140, 142, 143, 144, 218, 206, 207, 209

[56] References Cited

UNITED STATES PATENTS

| | | | |
|---|---|---|---|
| 1,301,970 | 4/1919 | Pritchard | 101/218 |
| 1,558,686 | 10/1925 | Lipton et al. | 101/144 |
| 2,545,836 | 3/1951 | Albrecht | 101/137 |
| 2,844,096 | 7/1958 | Koch | 101/144 |
| 2,916,988 | 12/1959 | Cragg | 101/144 |
| 3,264,981 | 8/1966 | Burger et al. | 101/144 |

FOREIGN PATENTS OR APPLICATIONS

| | | | |
|---|---|---|---|
| 2,022,114 | 12/1971 | Germany | 101/147 |
| 1,167,968 | 10/1969 | United Kingdom | 101/148 |

*Primary Examiner*—J. Reed Fisher
*Attorney, Agent, or Firm*—Leydig, Voit, Osann, Mayer & Holt, Ltd.

[57] ABSTRACT

A system for facilitating throw-off and re-engagement of a blanket cylinder with respect to cooperating plate and impression cylinders and which minimizes wastage of copies incident to reestablishing equilibrium in the inking and dampening systems following an interruption of the normal printing process. Two separate control means are provided for controlling the rate of water flow, the first being an automatic control at the water fountain and the second being in the form of means for controllably disengaging the water form roller from the printing plate. Means are provided for switching from the first control means to the second when the blanket is disengaged for promptly cutting off the flow and thereafter maintaining a water film of predetermined thickness on the plate. Simultaneously with disengagement of the blanket cylinder the ink feed rolls are declutched and the ink form rollers are disengaged for promptly cutting off flow of ink to the plate while preserving the film thickness gradient which exists in the ink feed system. A blanket cleaner is incorporated together with means for spraying solvent on the ink feed rolls. The throw-off mechanism is so arranged that, upon resumption of normal printing, the blanket is brought into engagement with the plate for a predetermined interval before it is engaged with the impression cylinder, thereby insuring that the blanket is re-inked to optimum degree before contact is made with the impression cylinder. As the blanket is brought into engagement with the plate, the inking system, with its pre-existing gradient, is reactivated and the control of water flow, after a delay interval, is restored to the water fountain, permitting the immediate printing of perfect copies.

17 Claims, 6 Drawing Figures fig.1b.
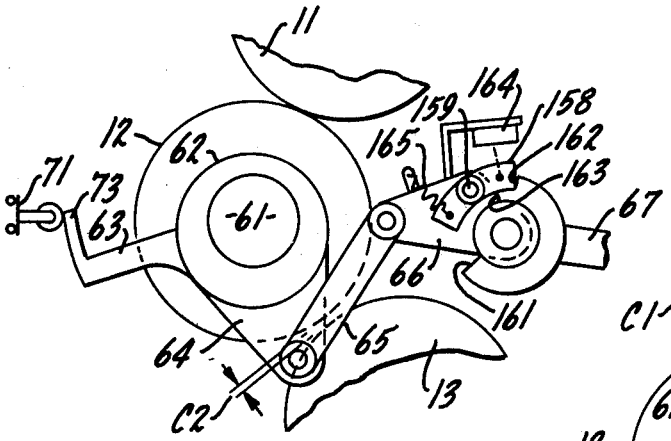
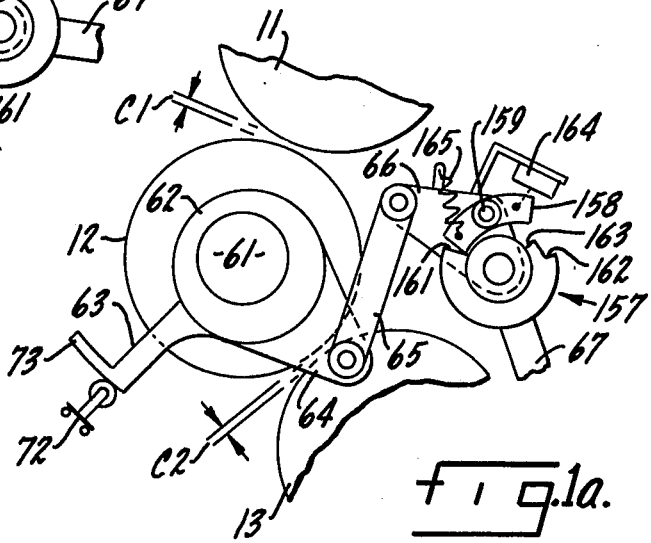
fig.1a.
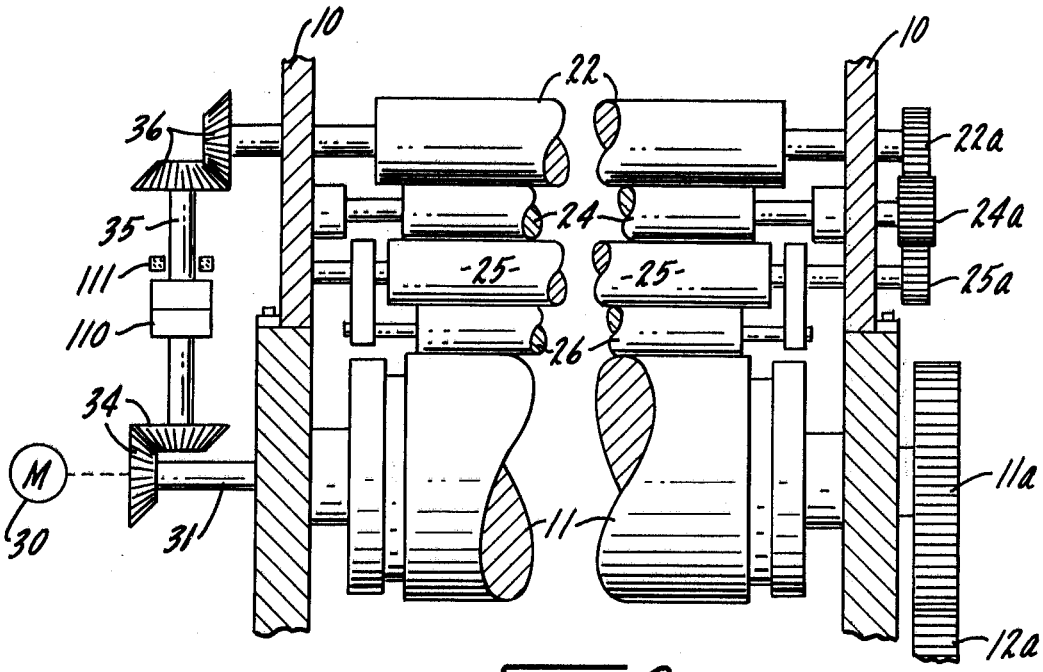
fig.2.

THROW-OFF SYSTEM FOR ROTARY OFFSET PRINTING PRESS

High quality printing on a lithographic press is dependent upon promptly establishing and maintaining equilibrium conditions in the ink and water feed systems. Sophisticated systems and devices have been developed for controlling the flow of both ink and water. However, it is an accepted fact that, even in lithographic presses of most advanced design, interruption of the printing process for any reason whatsoever, including necessity for periodic cleaning of the blanket, interrupts the equilibrium conditions so that when printing is resumed numerous copies are spoiled during the time required for the ink and water flow to come back into a balanced equilibrium condition. Not only do the spoiled copies represent an economic loss, but even where the shut-down is short resulting in only a few spoiled sheets, subsequent retrieval of the sheets from the production pile is time consuming and costly.

One of the main reasons for the spoiled copies upon resumption of the printing process is "over-linking" and resultant smearing. The presence of excess water, usually referred to as "flooding", also affects the quality of the printed product but it is well recognized that the two effects cannot be considered separately and that high quality printing requires optimum flow of both ink and water.

Efforts have been made in the past to prevent over-inking of the "resumption" copies by cutting back on the ink flow from the ink fountain or to the plate during the condition of throw-off, but this has not solved the problem. Our studies show that the problem is of a more subtle nature and that proper inking requires the maintenance of a thickness gradient from the beginning to the end of the ink flow path, the ink film being relatively thick at the fountain and progressing to a thin even film at the ink form roller. When the ink feed rolls are permitted to rotate during throw-off, without the ink being consumed, this gradient is lost, and even with reduced feed from the fountain a thick film tends to build up at the ink form roller resulting in the over-inking condition mentioned above when printing is resumed. Conversely, we have found that where the ink feed rolls are declutched during the condition of throw-off, and clutched in again upon resumption of printing, the normal operating gradient is preserved and its benefits are available for production of perfect initial copies.

Turning to the problem of water feed, it is known to provide means for constantly monitoring the thickness of the water film on the plate and to utilize a signal from the monitoring device to produce corrective control of water flow from a water fountain (see, for example, German patent No. 1,303,819). It might be expected that this would suffice to limit the thickness of the water film upon throw-off. However, in such automatic systems control takes place "upstream" in the water flow path so that there is a delay between the time that excess water is sensed on the plate and the time that corrective action is reflected at the water form roller so that even with conventional automatic control it is possible to have excess water at the plate (see German DAS No. 2,022,114 and U.S. Pat. No. 3,584,579). Similarly in conventional automatic systems, when water is consumed at the plate upon resumption of printing, the water fountain may overreact, because of the time delay in the system, resulting in overfeeding of water to the resumption copies until water equilibrium can again be established. In general, it is difficult to determine whether poor resumption copies have been the result of too much ink or too much water. Indeed, a solution to the problem is made more difficult by the fact that an axcess of water tends to mask the effects of an excess of ink.

However, our studies have shown that the effects of disruption of conventional automatic water control systems can be overcome by substituting, for the normal automatic control, an auxiliary control which is much more prompt and decisive in its response. More specifically we have found that, upon throw-off, flow of water to the plate should be controlled by oscillatory movement of the water form roller. By disengaging the water from roller upon throw-off of the blanket cylinder, there is immediate and complete cutoff of water to the plate, free of the time delay of the usual control. Moreover, by controllingly connecting the monitoring means to the oscillated water form roller, the form roller is caused to act intermittently to maintain a standby film of water on the plate thereby to make up for the effects of rapid evaporation. Indeed, it is one of the features of the present invention that a somewhat thicker film of water may be maintained on the plate during conditions of standby or throw-off, thereby insuring that the plate is kept "open" until normal printing may be resumed.

Throw-off mechanisms are known in which the blanket cylinder, upon reengagement, first engages the plate cylinder and then the impression cylinder. We have, however, found that this does not assure re-inking of the blanket, particularly after the blanket has been cleaned, and that it is desirable to include in the throw-off linkage, means for insuring that the blanket cylinder undergoes a predetermined number of revolutions in contact with the plate before the blanket is brought into engagement with the sheet on the impression cylinder.

A further complication in resumption of printing after throw-off is that the throw-off interval may be long or short, depending upon conditions, with the problems of resumption being roughly in proportion to the length of the throw-off interval. Thus when the blanket is disengaged for an extended period of time, on the order of several minutes, not only does the water evaporate but the solvents tend to evaporate from the ink so that the ink loses its tackiness. We have found it desirable, in order to overcome this, to provide a solvent sprayer under the control of a tackiness detector, and which is activated as normal printing is resumed automatically and in proportion to the loss of tack.

It is, accordingly, an object of the present invention to provide a throw-off system for a lithographic printing press which avoids the usual wastage of copies which occurs when printing is resumed following a condition of throw-off. It is an object, conversely stated, to provide a throw-off system which makes it possible, for the first time, to produce high quality printed copies following throw-off of the blanket cylinder regardless of the length of the throw-off interval, not only saving the cost of the spoiled copies but even more importantly the necessity for retrieving them from the delivery pile. It is, more specifically, an object of the present invention to provide a throw-off system in which the flow of ink and water are both cut off promptly at the surface of the printing plate by retraction of their respective form rollers, thereby eliminating the effects of time delay inherent in the usual ink of water automatic control system.

It is a specific object of the present invention to not only cut off the flow of ink to the plate upon throw-off but also to declutch the ink feed rolls so that the gradient of ink film thickness therein is preserved and so that advantage can be taken of such gradient when normal printing is resumed, thereby to avoid the problem of over-inking the initial copies. In short, the pre-existing conditions of equilibrium and balance are preserved over the time interval and need not be re-established.

With respect to the water feed system, it is an object to provide normal and auxiliary water control means, both of which are under the control of a film thickness monitoring device, and in which the auxiliary control means is in the form of an oscillated water form roller, which not only is effective, upon throw-off, to achieve immediate limitation or cut-off in the flow but which is effective to reestablish contact with the plate at intervals thereafter for the purpose of maintaining on the plate a standby water film to counteract the effects of evaporation regardless of the length of the throw-off interval, a water film which is preferably slightly thicker than the normal film used in the printing operation so as to insure that the plate is kept "open" during the entire throw-off interval. Using the present system, moreover, there is no risk of hunting or surging of either ink or water as the normal printing condition is reestablished.

It is yet another object of the present invention to provide a novel throw-off mechanism in which the blanket cylinder, at the end of the throw-off interval, is first engaged with the plate and thereafter engaged with the impression cylinder, with improved operating linkage for insuring that the blanket cylinder is in exclusive contact with the plate cylinder for a predetermined minimum time interval, at least several revolutions, thereby insuring that the blanket is adequately re-inked before being brought into contact with the paper. In this connection, it is an object to provide a linkage which achieves the above sequence and result automatically and with minimal thought or attention on the part of the press operator; indeed it is a general object of the present invention to provide a throw-off system which is capable of achieving perfect copies following an indefinite throw-off interval without exercise of skill or judgment on the part of the press operator.

Other objects and advantages of the invention will become apparent upon reading the attached detailed description and upon reference to the drawings in which:

FIG. 1 is an elevational diagram of a lithographic type printing press including inking and dampening systems constructed in accordance with the present invention.

FIG. 1*a* is a fragmentary view based upon FIG. 1 and showing complete throw-off of the blanket cylinder.

FIG. 1*b* is a figure similar to FIG. 1*a* but showing the re-engagement of the blanket cylinder with the plate cylinder for re-inking of the blanket.

FIG. 2 is a fragmentary layout view taken along line 2—2 in FIG. 1.

While the invention has been described in connection with certain preferred embodiments, it will be understood that there is no intention to limit the invention to the embodiments illustrated, but it is intended, on the contrary, to cover the various alternative and equivalent forms of the invention included within the spirit and scope of the appended claims.

Figure 1:
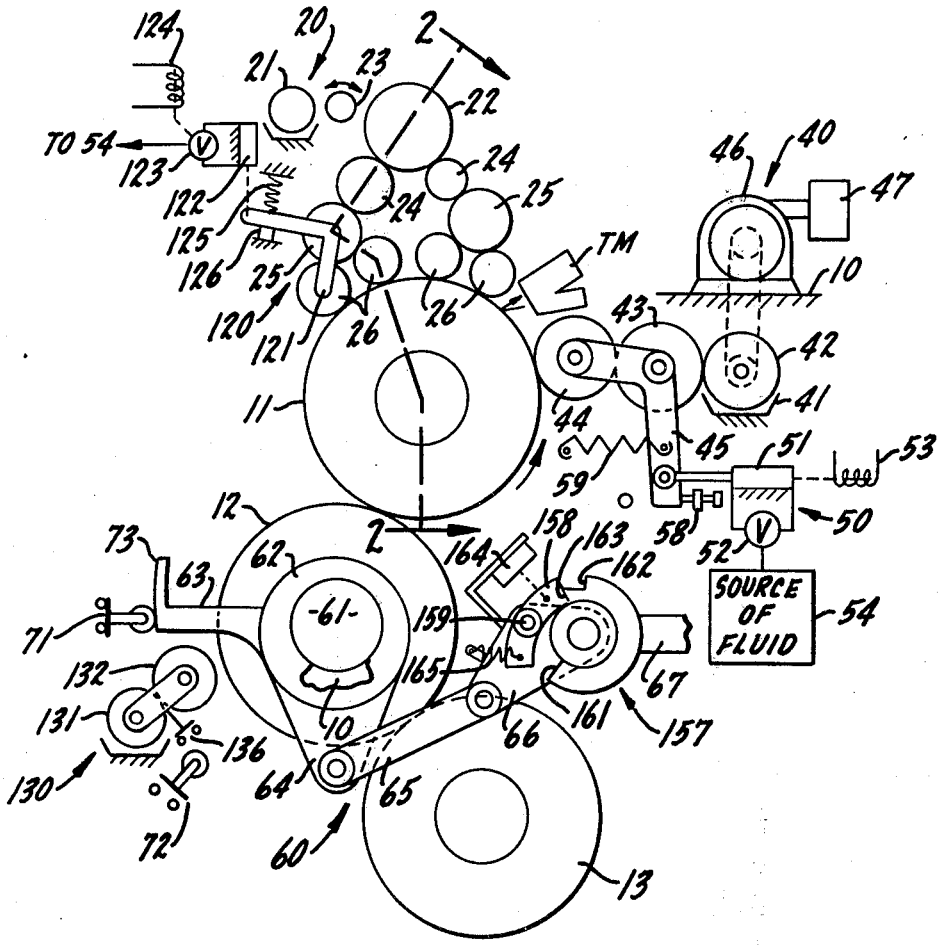

Referring now to FIGS. 1 and 2 there is shown a portion of a lithographic printing press having a frame 10, a plate cylinder 11, a blanket cylinder 12 and an impression cylinder 13. It will be understood, as in the normal operation of any lithographic press, that a printing plate, fixed to the plate cylinder 11, with applied films of ink and water, "offsets" the printed image upon resilient rubber blanket 12 on the blanket cylinder. Printing takes place as the blanket, carrying the image, engages a sheet or web of paper carried by the impression cylinder 13.

For the purpose of forming an ink film upon the printing plate, an ink feed system 20 is provided including an ink fountain 21 and an ink drum 22. Known means may be provided for conveying ink from the fountain roller to the ink drum; for example, an oscillating ductor roller 23 may be interposed. The ink film from the drum is transmitted via pair of intermediate feed rolls 24 to respective vibrated rollers 25, from which the film is conveyed to the plate by resiliently covered form rollers 26.

For the purpose of driving the cylinders and rollers, a conventional press drive is provided including a drive motor 30 having connections 31, 32, 33 to the respective cylinders, it being understood that the blanket and impression cylinders may be driven from the plate cylinder via a set of gears including the gears 11*a*, 12*a* shown in FIG. 2. The ink feed rolls are driven from shaft 31 by a set of bevel gears 34, a shaft 35 and second set of bevel gears 36 leading to the ink drum 22. The intermediate rollers 24 and vibrated rollers 25 are driven from the ink drum via gears 24*a*, 25*a*. It will be understood that the ink feed system includes the usual fountain blade or other means (not shown) for controlling the thickness of the transmitted ink film, preferably on a column by column basis.

For the purpose of furnishing a film of water to the plate on the plate cylinder a water feed system 40 is provided having a water fountain 41 including a fountain roller 42 which is in rolling engagement with a water feed roller 43 which, in turn, contacts a water form roller 44 riding in contact with the printing plate. The water form roller is mounted upon a lever 45. For the purpose of normally varying the water feed rate, the fountain roller 42 is connected to a fountain drive motor 46 having a speed control means 47.

For controlling the thickness of the water film upon the plate, a thickness monitoring device TM is provided. Such monitoring device is preferably of the type which directs a beam of light at the plate, with the scattered and reflected light being picked up and utilized to produce an output signal which is a direct measure of film thickness. A monitoring device capable of being used in the present invention is disclosed in copending application Ser. No. 558,307, filed Mar. 14, 1975. It will be understood that under normal printing conditions the thickness of the water film on the plate is constantly measured by the device TM resulting in a corrective variation in the speed of the motor 46 connected to the fountain roller, with the result that a water film of constant thickness tends to be maintained on the plate.

In accordance with one of the important features of the present invention a seond auxiliary water flow control device, or organ, is provided, in the form of oscillating means connected to the water form roller and which is placed under the control of the film monitoring device upon throw-off of the blanket cylinder resulting in immediate termination of flow at the instant of throw-off, free of the time delay which is associated with the normal water control means, but with the water film on the plate being thereafter replenished with a film of predetermined thickness automatically during the throw-off interval. Further in accordance with the invention the first water flow control means, at the fountain, is temporarily disabled, with the fountain motor 46 being held at a speed corresponding to that which existed just prior to throw-off. The oscillating means which is used in the present instance, and which is generally indicated at 50, includes an actuator 51 under the control of a fluid valve 52 controlled by a solenoid 53 and with the valve being connected to a source of fluid 54. While the actuator 51 may be of the single acting type, a double acting unit has been illustrated under the control of alternate lines 56, 57 (see FIG. 3). The normal position of the lever 45 which carries the form roller 44 is determined by a stop 58, and a biasing spring 59, in opposition to the stop, may be used.

Prior to a discussion of the means for disabling the first water control device, and energizing the second, upon throw-off of the blanket cylinder, attention may be given to the means for achieving throw-off as illustrated at 60 in FIG. 1. Here it will be noted that the blanket cylinder 12 is mounted in a set of spindles 61, only one of which is shown, the illustrated spindle being contained in an eccentric bushing 62 which is supported in the press frame at its outer surface 63 for rocking movement by an arm 64. The arm 64 is moved by operating linkage including a line 65 which is connected at its opposite end to a crank arm 66 which is, in turn, coupled to a manual throw-off lever 67. Special means are interposed between the manual throw-off lever and the crank arm to insure that the blanket cylinder is re-engaged with the plate cylinder 11 and impression cylinder 13 in a properly timed sequence. It will suffice for the present to note that when the eccentric bushing 62 is rocked to an extreme position, fully counterclockwise as shown in FIG. 1*a*, the spindle 61 is subject to maximum "throw" outwardly of the cylinders 11, 13, resulting in a clearance C1 between the blanket cylinder and the plate cylinder and a clearance C2 between the blanket cylinder and the impression cylinder, so that the blanket is fully isolated. Upon partial return of the eccentric bushing 62, in the clockwise direction, as illustrated in FIG. 1b, the clearance C1 is taken up resulting in contact between the blanket cylinder and the plate cylinder, while clearance C2 still exists. Upon further restorative clockwise movement of the eccentric bushing 62 to the running position illustrated in FIG. 1, the gap C2 is closed, bringing the blanket cylinder into contact with the sheet on the impression cylinder for normal printing.

For the purpose of detecting whether the blanket cylinder is in its running position or fully thrown off position, a control circuit 70 is provided having a normal position limit switch 71 and a throw-off limit switch 72, with both limit switches being in the path of movement of a switch arm 73 connected to the bushing 62. In carrying out the present invention, the switch 71 makes contact in both the normal runnning condition and the re-inking condition illustrated in FIGS. 1 and 1b. Limit switch 71 serves to control a relay 80 (shown energized in FIG. 3) having contacts 81–85, while the limit switch 72 serves to control an alternate relay 90 having contacts 91–93.

Under normal running conditions, then, relay 80 is energized, thereby closing contact 81 of the relay, completing a circuit, via lines 94, 95, which controllingly couples the thickness monitoring device TM to the motor speed control 47 so that the motor 46 of the water fountain tends to rotate at a speed which will produce a predetermined thickness of water film on the plate under normal operating conditions as water is being consumed. That is to say, should the water thickness under normal operating conditions increase above an equilibrium level, a signal will be produced on line 94 and applied through line 95 in a direction to reduce the speed of the fountain motor 46. Upon decrease in the thickness below the predetermined level, the opposite will occur.

Figure 3:
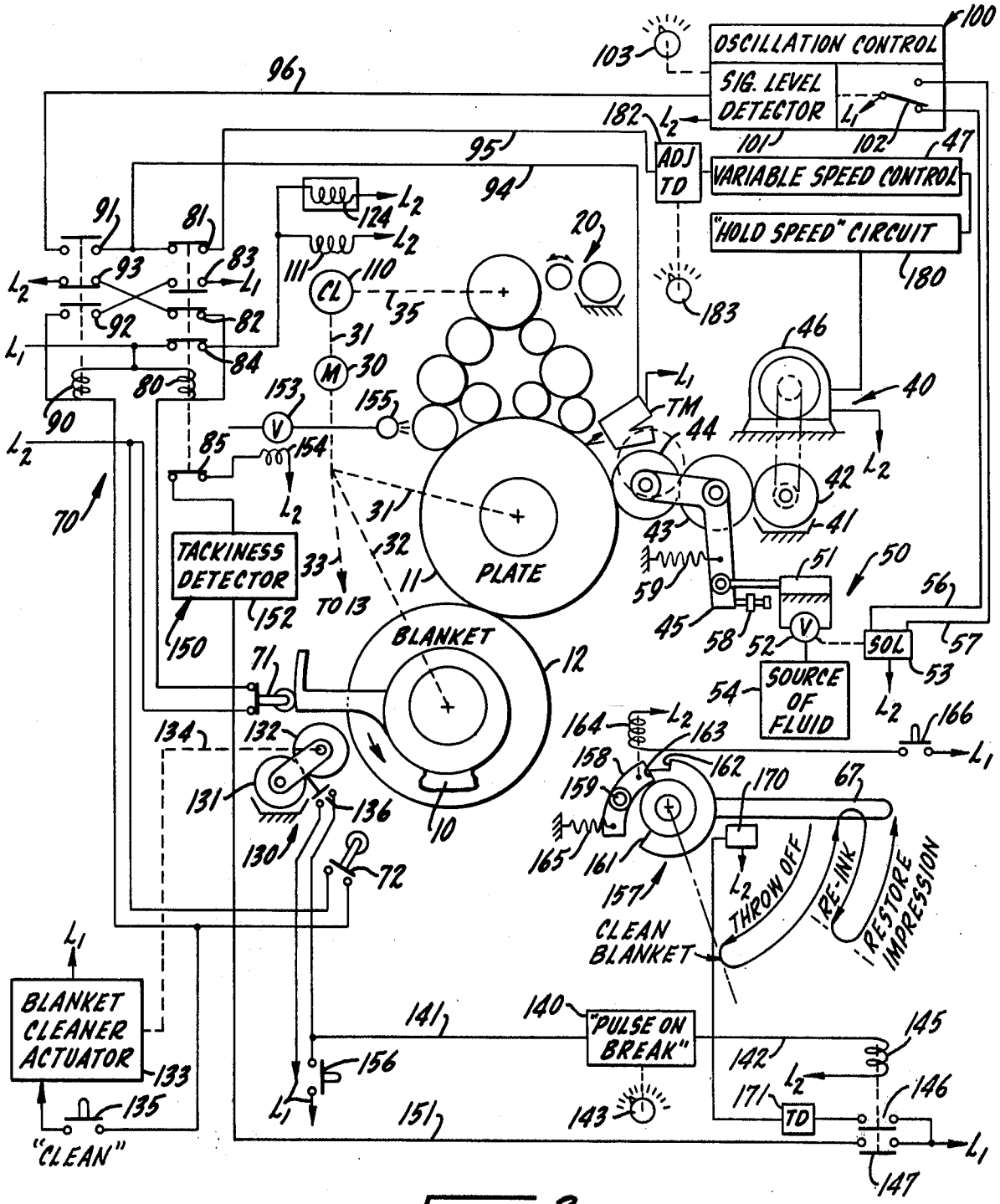
FIG. 3 shows a schematic control circuit which may be employed in carrying out the present invention.

In the exemplary control system of FIG. 3, means are provided for switching from the normal water control system 40 to the auxiliary control system 50 upon completing throw-off of the blanket and for restoring normal control when the blanket is re-engaged. This is accomplished by connecting the contact 91 of relay 90 to the auxiliary water control 50 via line 96 and by providing interlocked sealing circuits for the two relays 80, 90. Thus the relay 80 has a sealing circuit which includes a normally open contact 82 on relay 80 and a normally closed contact 93 on relay 90. Symmetrically, relay 90 has a sealing circuit which includes a normally open contact 92 and normally closed contact 83. The operation of these contacts will be apparent upon considering a typical throw-off cycle. Thus when the blanket cylinder is thrown off with accompanying movement of the switch arm 73 in the direction shown by the arrow in FIG. 3, the limit switch 71 is opened. This does not, however, result in drop-out of the relay 80 since such relay is held in by its sealing contact 82. However, when the switch arm 73 strikes the throw-off limit switch 72, causing energization of the relay 90, the opening of normally closed contact 93 causes drop-out of the relay 80. This results in opening of the contact 81 which disables the normal motor speed control device 47 and the closing of contact 91 which puts into operation the auxiliary water feed control system 50, the contact 91 serving to connect the water thickness monitoring device TM to the auxiliary control system via lines 94, 96.

For the purpose of controlling the movements of the actuator 51 which is connected to the water form roller 44, to oscillate the latter, an oscillation control 100 (FIG. 3) is interposed. Such oscillation control, while set forth diagrammatically, will be readily understood by one skilled in the art. It includes a signal level detector 101 operating a single-pole, double-throw switch 102 controlling the lines 56, 57 leading to the solenoid 53. Means are provided in the signal detector for responding to the output signal from the water monitoring device TM. When such signal exceeds a predetermined level, indicating that the water film thickness is greater than desired, the detector 101 responds to throw the switch 102 in a direction which will cause the actuator 51 to swing the form roller 44 out of engagement with the plate, thereby immediately cutting off the water flow to the surface of the plate, free of the time delay which is inherent in the normal water control means 40. Conversely when the signal from the water monitor drops below a predetermined level, indicating that the water film on the plate requires replenishment, this fact is detected by the detector 101 resulting in the throwing of the switch 102 in the opposite direction, thereby bringing the form roller 44 back into contact with the plate to build up a film thereon to desired depth. It will be understood, however, that since the fountain roller 42 continues to rotate and continues to feed water into the system even when the control therefor is disabled, replenishment will promptly occur within a single revolution of the plate cylinder, with the increased thickness being detected by the water monitor resulting in rather prompt switching of the switch 102 to the opposite position for again disengaging the water form roller.

In this way it will be seen that the auxiliary water control means 50 performs two valuable functions: In the first place, upon throw-off of the blanket cylinder 12 the water form roller 44 is immediately disengaged to prevent further build-up of water film without the time delay of the regular control means; nevertheless, the form roller 44 is thereafter directed by the water monitor to make brief contact with the surface of the plate for replenishing the water film thereon as necessary and to compensate for the rapid evaporation which occurs during throw-off. The signal level detector preferably includes an adjustment 103 for adjusting the equilibrium level of the water film thickness under conditions of throw-off, that is, the threshold point for operating the double-throw switch 102. Preferably the equilibrium film thickness under throw-off conditions is made greater than the equilibrium thickness during normal running in order to insure that the plate on the plate cylinder remains "open" during the entire throw-off interval.

In accordance with another important aspect of the present invention means are provided for clutching the drive to the ink feed rolls during normal printing conditions and for declutching the drive, and interrupting transfer of ink to the plate, under conditions of throw-off. This is accomplished by an ink feed clutch 110 having a control winding 111 which is connected to the normally open contact 84 on the relay 80, the same relay which energizes the normal water feed control 40. Thus under conditions of normal printing the clutch 110 is engaged so that the ink feed rolls, illustrated in FIG. 2, rotate in the usual manner. However, under conditions of throw-off, contact 84 is opened, disengaging the clutch 110 to prevent further rotation of the ink feed rolls, thereby preserving the ink gradient, as will be discussed in greater detail.

In carrying out the invention means are provided for disengaging all of the ink form rollers 26 at the same time that the ink feed rolls are silent. A typical ink form roller disengage mechanism is set forth at 120 in FIG. 1. Here it will be noted that the left-hand form roller 26 is mounted upon a lever 121 which is connected to an actuator 122 having a control valve 123 controlled by a solenoid 124. The same source of fluid 54 may be utilized as in the case of actuator 51 previously discussed. Under normal printing conditions the solenoid 124 is energized (in parallel with the clutch winding 111), causing the actuator 122 to be extended, interposing the form roller 26 in normal position against the printing plate. However, when the blanket cylinder 12 is thrown off, resulting in closure of limit switch 72 and dropping out of relay 80, contact 84 opens, thereby deenergizing solenoid 124 which results in contraction of the actuator 122 and disengagement of the form roller 26. If desired, to facilitate retraction, the effect of the actuator 122 may be supplemented by a retraction spring 125. A stop 126 determines the running position.

While an ink form roller retracting mechanism 120 has been illustrated, in FIG. 1, only with respect to the left-hand one of the ink form rollers, it will be understood that this has been done only to keep the figure as simple as possible and similar mechanisms 120, under the control of similar solenoids 124, will be provided, in a practical case, for each of the ink form rollers. To insure synchronization, all of the solenoid windings 124 will be connected in parallel.

By way of summary of the structure and control circuitry thus far described, it will be understood that under normal printing conditions, with relay 80 energized, the feeding of water, in accordance with the signal from the water thickness monitor TM, will be controlled by the normal water control 40 to maintain a desired running film thickness and with water form roller 44 in normal position. At the same time the ink feed rolls will operate normally to transfer an ink film from the ink fountain to the ink from rollers 26 in normal ink transferring position. However, when the control lever 67 is operated, thereby throwing off the blanket cylinder 12 into the position illustrated in FIG. 1*a*, the resulting opening of switch 71 and closing of switch 72 deenergizes the relay 80 which disconnects the water monitor line 94 from the normal water control means 40. Simultaneously the clutch 110 is disengaged causing the ink feed rolls to immediately become stationary, and the ink form rollers 26, associated therewith, are all disengaged, thereby to isolate the ink feed system. The silencing and isolation of the ink feed system is particularly significant for the following reasons: Under normal running of the press a thickness gradient exists between the ink fountain and the film of ink on the form rollers. By silencing the ink feed rolls, any further transfer of ink is immediately halted and the thickness gradient is preserved so that the form rollers 26 never receive more than the thickness of ink which they receive under printing conditions. By contrast, if the ink feed rolls had been allowed to continue rotation during the condition of throw-off, the thick ink film in the neighborhood of the ink fountain would gradually work its way down to the form rollers 26, destroying the thickness gradient, and causing the plate to be overly inked upon subsequent re-engagement of the ink form rollers.

At the same time that the relay 80 is deenergized, the relay 90 is energized, closing contact 91 and causing the monitor TM to be connected, via line 96, to the water form roller oscillation control 100. Such control immediately responds by throwing the switch 102 into a position to cause immediate retraction of the water form roller 44 without any time delay, thereby preventing transfer of any unneeded water to the plate on the plate cylinder while nevertheless replenishing the water film on the plate, automatically as needed, during the entire interval of throw-off to keep the plate open and in readiness, regardless of the length of the throw-off interval.

There are, of course, may reasons why it may be necessary to throw off the blanket cylinder. One of the reasons is to isolate the blanket cylinder for cleaning of the blanket which is necessary following the printing of each approximately three thousand copies in order to remove any adhering paper fibers and to sharpen the offset image.

In accordance with one of the aspects of the present invention, means are not only provided for cleaning the blanket but for insuring that, following cleaning, ample rotation of the blanket cylinder occurs, in contact with the plate cylinder, to achieve adequate re-inking of the blanket before the blanket is brought into contact with a sheet to be printed. This benefit results as a combined effect of the illustrated control circuitry and a special ratcheting connection with is interposed between the operating lever 67 and the eccentric 62. Moreover, means responsive to the cleaning process are provided for spraying solvent, if necessary, upon the ink feed rolls to insure that the ink, notwithstanding the length of the throw-off interval, will be in the proper tacky state for application to the blanket.

Giving attention first to the blanket cleaner, indicated generally at 130, it includes a fountain roller 131 and an applicator roller 132, the fountain being filled, as is conventional, with a suitable solvent. For the purpose of shifting the applicator roller 132 to the blanket, a blanket cleaner actuator 133 is provided having a mechanical connection 134 and capable of being triggered into operation by a pushbutton 135 as long as the blanket cylinder is in the thrown-off state. Thus the pushbutton 135 is effectively connected in series with the contact of the second limit switch 72. For signalling the end of the cleaning process a normally open switch 136 is provided, operated by the cleaner frame and closed during the time that the applicator roller 132 is performing a cleaning function. In accordance with one of the more detailed aspects of the invention means are provided for responding to the breaking of the contact 136, which occurs when cleaning is completed, for energizing a latch which latches in position the manual operating arm 67 as well as for initiating the spraying of the ink feed rolls. Thus, connected to the normally open contact 136, is an auxiliary circuit 140 having an input terminal 141 and an output terminal 142 and which is identified by the legend "pulse on break". The device 140 is so constructed as to respond to the breaking of contact 136, signalling the completion of cleaning, and for thereupon applying a pulse to the output line 142 of a duration which depends upon the setting of an adjustable control 143. The pulse in a practical case may be a number of seconds in length. Responsive to the pulse is a relay 145 having a first normally open contact 146 and a second normally open contact 147. The latter controls application of voltage to a tackiness control system 150 having an input line 151, a tackiness detector 152 and a valve 153 having a solenoid 154 and which controls the spraying of solvent from a spray head 155. The tackiness detector 152 may, for example, be of the type disclosed in U.S. Pat. No. 3,901,149 and coupled to any one of the ink feed rolls.

In operation, then, with the blanket cylinder in its thrown-off condition and with the limit switch 72 closed, pressing of the pushbutton 135 initiates the cleaning operation by rocking the applicator roller 132 against the blanket, incidentally making contact at 136. The actuator 133 may include means for keeping the applicator roller 132 in contact with the blanket for a predetermined length of time and automatically retracting it, such being well within the skill of the art. The retraction of roller 132, breaking contact 136, causes the pulsing device 140 to put out a pulse of predetermined time duration energizing the relay 145 and closing the contacts 146, 147. Closure of contact 147 energizes the solenoid 154, or not, depending upon the degree of tackiness of the ink. If the throw-off interval has been short, the tackiness may be adequate so that no solvent is necessary. However, if the throw-off interval has been relatively long, the tackiness detector 152, sensing lack of tack, permits the solenoid 154 to be energized thereby opening the valve 153 and causing discharge of solvent from spray head 155, thereby insuring that the ink is in proper state for re-inking of the blanket. To insure that the ink feed rolls are rotating when the spray is applied, an interlock contact 85, on relay 80, is preferably connected in the sprayer control circuit. An auxiliary pushbutton 156 is provided for energizing the circuit in lieu of the blanket cleaner contact 136.

The function of the contact 146, which serves to latch the manual operating lever 67, can be understood by considering, first, the nature of the special ratcheting connection between the operating lever 67 and the eccentric bushing 62 which supports the blanket cylinder.

Thus in accordance withone of the important aspects of the invention, a ratcheting connection 157 is provided between the operating arm 67 and the crank arm 66. Such a connection includes a rockable pawl 158 which is centrally pinned, at 159 to the crank arm 66, and which engages a plurality of stop surfaces on the operating lever. Specifically, the pawl 158 engages a first or throw-off stop surface 161, a second, or re-inking, stop surface 162 and a third or "running" stop surface 163. For controlling the position of the pawl a solenoid 164 is provided having an associated return spring 165.

The operation of the ratcheting connection may be understood by considering, in sequence, FIGS. 1, 1*a* and 1*b*, with return to FIG. 1.

FIG. 1 shows the running condition with the pawl seated against the running stop surface 163. To effect throw-off, the operating lever 67 is swung downwardly, bringing the throw-off stop surface 161 against the pawl 158 to produce clockwise rotation of the crank arm 66 into the position shown in FIG. 1*a* which is the position of full throw-off. It is in this position that the blanket cleaner is actuated followed automatically by operation of the relay 145. When cleaning has been completed, the pawl 158 is operated, by means of solenoid 164, by pressing a pushbutton 166, thereby causing the pawl to assume the position in which it engages the second, or re-inking, stop surface 162. Swinging the lever 67 upwardly thus causes the eccentric bushing 62 to be rotated into the position illustrated in FIG. 1b in which the blanket cylinder is in contact with the plate cylinder but in which there is clearance between the blanket cylinder and impression cylinder. In other words, restoring the lever 67 to the position it originally occupied is not effective to restore the blanket cylinder 12 fully to running position. On the contrary, it requires another, but smaller, "ratcheting" stroke of the operating lever 67 to achieve contact with the paper. Sufficient "lost motion" is, however, provided in the first limit switch 71 so that the limit switch contacts are closed in both the running mode illustrated in FIG. 1 and in the re-inking mole illustrated in FIG. 1*b*. This insures that the ink feed rolls will be clutched in operation, and the ink form rollers 26 will be in place, to feed an ink film to the plate for re-inking of the blanket.

After the manual lever 67 has occupied its upper position (FIG. 1*b*) sufficiently long for re-inking to have been completed, the lever 67 is swung downwardly again (pushbutton 166 having been released) causing the pawl 158 to drop ahead of the third or running stop surface 163. The lever 67 is, finally, swung back into its upper position (FIG. 1), rocking the eccentric bushing 62 a final amount to bring the blanket cylinder into running engagement with the impression cylinder to begin actual printing. The plural stops 161–163 thus serve a ratcheting function, requiring the actuating lever 67 to be double stroked to achieve full broadwise movement of the blanket cylinder back to printing position. Because of the inherent delay between the strokes, and the length of the second downward stroke of the actuating lever, the blanket cylinder is kept in contact with the plate cylinder for several revolutions, in any event an adequate time for the blanket to be fully re-inked.

However to further insure that the manual lever 67 occupies its upper position sufficiently long for the blanket cylinder to undergo an adequate number of re-inking rotations, a latch 170 may be provided having a suitable latching element (not shown) interposed under the lever 67 and connected to contact 146 of relay 145, with a timing device 171 imposed in the circuit. Such timing device, which is preferably of the adjustable type, insures that the operating arm is captured and held in its re-inking position for a delay interval. Following expiration of the pulse from device 140 the relay 145 will drop out, but the latch may be operative thereafter for such additional delay interval as may be necessary to insure adequate re-inking.

As stated above, it is one of the features of the present invention that the ink thickness gradient is preserved over the throw-off interval so that the ink which begins to be fed to the plate following the interval is fed at a normal running thickness rather than at an augmented thickness. It is a further feature of the invention that, following the throw-off interval, and by reason of closure of the relay 80, and opening of relay 90, control is restored to the normal water feed control 40, so that normal printing may resume. However, in accordance with one of the detailed, yet important, features of the invention the water fountain motor 46 continues to operate at its last controlled speed, and a time delay device is interposed to delay turning the motor speed control back to the water monitor for a predetermined, additional time interval. Thus we provide, associated with the motor speed control 47, a "hold speed" circuit 180. Such a circuit has been only diagrammatically shown since the actual connections are well within the skill of the art. The hold speed circuit simply serves to hold the speed of the fountain motor 46, during periods during which normal variable control is disabled, at its last controlled speed, that is, at the speed at which such motor 46 was operating under normal printing conditions just prior to throw-off of the blanket cylinder. Thus the normal water control system 40 continues to hold the water at a level rate during conditions of throw-off, even though its variability has been disabled and it is no longer under the control of the water monitor. An adjustable time delay device 182 interposed in the lead 95 to the motor speed control 47 insures that upon return to the re-inking condition the motor speed control will not immediately respond to the water monitor, which prevents the control from over-responding and possibly providing a surge of water to the plate. In short, interposition of the time delay 182 serves to add stability to the system and to inhibit a tendency toward hunting for the point of water equilibrium. The amount of time delay to achieve stability is preferably variable in accordance with the setting of a time delay control 183.

Figure 4:
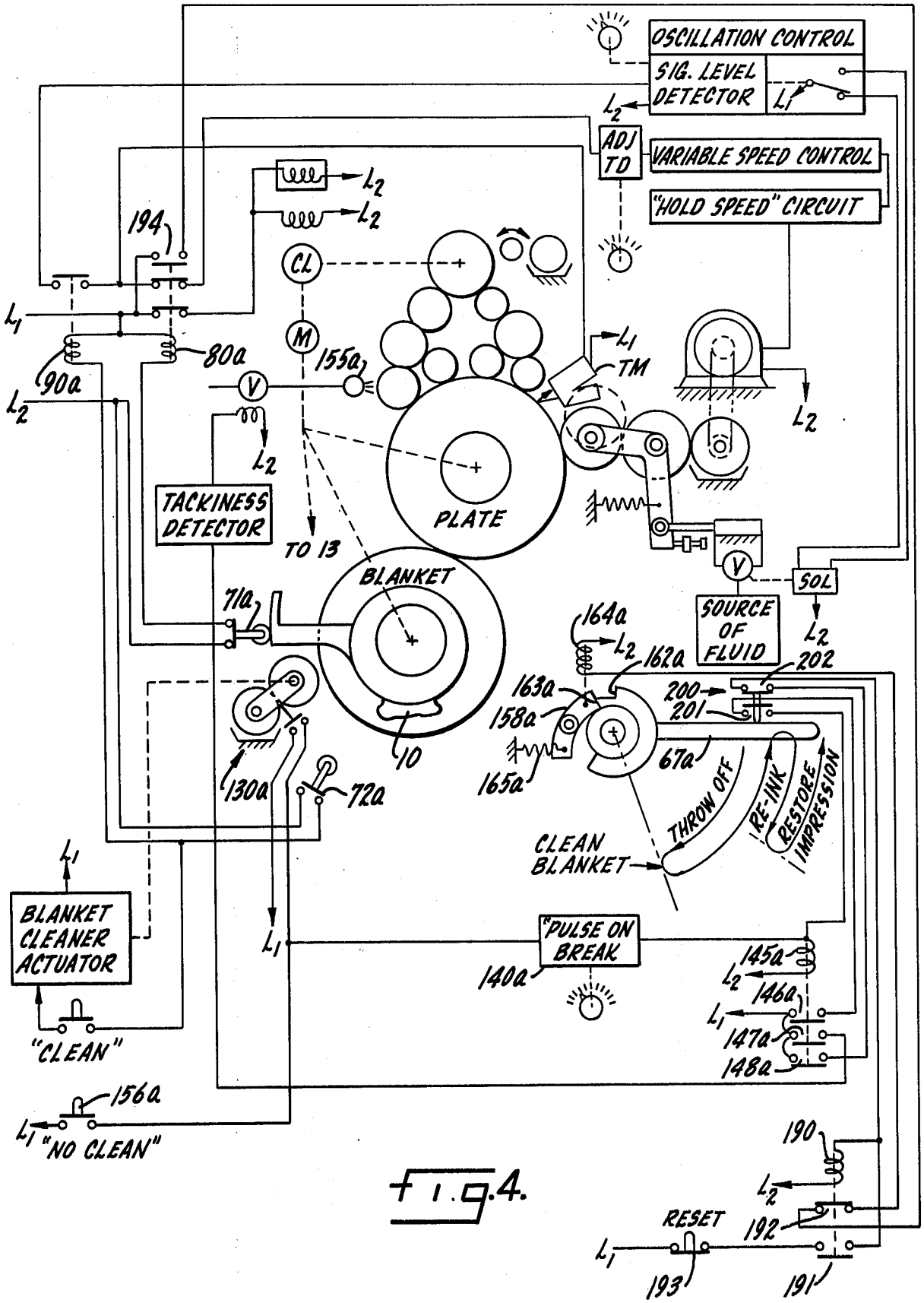
FIG. 4 shows a modified form of control circuit.

The present invention has been described in connection with a simplified control circuit of FIG. 3 in which there is provision for switching of the pawl 158 manually under control of a pushbutton or the like 66. However, it is contemplated, in one of the aspects of the invention, that the pawl 158 may be automatically controlled so as to operate at a "high" level to engage stop 162 during the first stroke of the lever 67, to achieve re-inking condition, and to operate, deenergized, at a "lower" level for engagement of the running stop surface 163 incident to the second, or ratcheting, stroke. An alternate circuit showing automatic pawl control is illustrated in FIG. 4 in which corresponding reference numerals are applied to the components which the circuits have in common with the addition, however, of subscript *a*. Thus a relay 145*a* is employed having normally open contacts 146*a* –*148a*. The contacts 148*a* are used to control a pawl relay 190 having a normally open sealing contact 191 and a normally closed pawl contact 192. The sealing contact is contact in series with a normally closed pushbutton 193. Current is furnished to the pawl solenoid 164*a* from a normally closed contact 194 on relay 80*a*. In order to provide the desired sequencing a limit switch 200 having a normally open contact 201, and a normally closed contact 202 is provided to sense the arrival of the operating lever 67*a* at its upper position.

The operation of such portion of the circuit, set forth in FIG. 4, is as follows: Let it be assumed that the manual lever 67*a* is in its lower position, that cleaning has just been completed, producing a pulse from the device 140*a* closing relay 145*a*. Such relay seals itself in through contacts 146*a*, 201. Closure of contact 147*a* initiates operation of the spray head. Closure of contact 148*a* is ineffective since the limit switch contact 202 which is in series with it is, at such time, open. Thus relay 190 remains deenergized and contact 192 thereon remains closed so that the pawl solenoid 164*a* continues to be energized.

Upon completion of the cleaning operation the manual lever 67*a* is rocked to its upper position which corresponds to the re-inking mole illustrated in FIG. 1*b*. Contact 202 thereupon closes, energizing the auxiliary pawl relay 190 and opening the contact 192 of the latter while closing the contact 191. Closure of the contact 191 seals in the relay 190, thus holding the contact 192 open and open circuiting the pawl solenoid 164*a* so that the pawl is now under the control of the spring 165, resting upon the "shelf" between the stop surfaces 162, 163.

Thus when the lever 67*a* is ratcheted downwardly at the completion of the re-inking, the pawl 158*a* falls into place adjacent the operating stop surface 163, so that when the manual lever 67 is pulled up into its final operating position the blanket cylinder 12 engages the impression cylinder 13 and printing resumes.

In short, the interlocking limit switch 200 and relay 190 serve to provide automatic deenergization of the pawl solenoid 164 for dropping of the pawl to achieve ratcheting, thereby enabling the pushbutton 166 (FIG.

3) to be dispensed with. However, in order to break the sealing circuit of the relay 190 to restore the initial condition, an auxiliary reset pushbutton 193 is provided for pressing when the cycle is completed.

A further difference between the control circuits of FIGS. 3 and 4 is the fact that in the circuit of FIG. 3 the relays 80, 90 are interconnected with a mutual holding circuit so that instantaneous transfer takes place between the two water control systems, whereas in FIG. 4 the relays 80*a*, 90*a* are independently controlled by the two limit switches 71*a*, 72*a* with the control devices being energized at the respective eccentric positions.

The circuit of FIG. 4 includes pushbutton 156*a* to initiate energization of the layers 145*a* and 190 when the cleaning device 130*a* is not used. 26

The term "water" as used herein will be understood to refer to any dampening liquid. The term "fountain" refers to any upstream source of ink or water. The term throw-off, unless specially qualified, refers to the final separation of the blanket cylinder relative to the plate cylinder.

We claim as our invention:

1. In a lithographic press, the combination comprising a press drive, a plate cylinder, blanket cylinder and impression cylinder, means including a series of ink feed rolls clutched to the press drive for applying a film of ink to the plate on the plate cylinder, a water feed system for applying a film of water to the plate on the plate cylinder, means for constantly monitoring the thickness of the water film and for producing an output signal in accordance therewith, the water feed system including a fountain and a water form roller with at least one water feed roller interposed therebetween, means for throwing off the blanket cylinder to interrupt normal printing, first flow control means in the form of means responsive to the monitoring means for correctively adjusting the fountain to control the rate of water feed to the form roller and plate during normal printing, the fountain being sufficiently upstream in the water feed path so that there is a delay between the making of an adjustment at the fountain and a resulting change in film thickkness at the plate, second water flow control means in the form of means responsive to the monitoring means for cyclically engaging and disengaging the water form roller from the plate to control the feeding of water to the plate, means operated incident to throw-off of the blanket cylinder for energizing the second flow control means, with the relatively rapid response of the second flow control means as compared to the first flow control means serving to promptly limit and maintain a film of predetermined thickness on the plate, means operated incident to throw-off of the blanket cylinder for declutching the ink feed rolls, and means operated incident to reengagement of the blanket cylinder for disabling the second flow control means and for reclutching the ink feed rolls.

2. In a lithographic printing press, the combination comprising a plate cylinder, blanket cylinder and impression cylinder, means for applying a film of ink to the plate on the plate cylinder, a water feed system for applying a film of water to the plate on the plate cylinder, the water feed system including a fountain and a water form roller with at least one water feed roller interposed therebetween, means for throwing off the blanket cylinder to interrupt normal printing, means for monitoring the thickness of water film on the plate cylinder and for producing a control signal in accordance therewith, first water flow control means coupled to the monitoring means for adjusting the fountain to control the rate of water feed to the form roller and plate during normal printing, the fountain roller being sufficiently upstream in the water feed path so that there is a delay between the making of an adjustment at the fountain and the resulting change in film thickness at the plate, second water flow control means coupled to the monitoring means for temporarily disengaging the form roller from the plate to control the feeding of water to the plate, means responsive to the interruption of normal printing for disabling the first flow control means and for energizing the second flow control means for promptly reducing flow of water to the plate, and means responsive to re-engagement of the blanket cylinder with the plate cylinder for disabling the second flow control means and for restoring the control of flow to the first flow control means.

3. In a lithographic press, the combination comprising a plate cylinder, blanket cylinder and impression cylinder, means for applying a film of ink to the plate on the plate cylinder, a water feed system for applying a film of water to the plate on the plate cylinder, means for constantly monitoring the thickness of the water film, the water feed system including a fountain and a water form roller with at least one water feed roller interposed therebetween, means for throwing off the blanket cylinder to interrupt normal printing, first flow control means in the form of means responsive to the monitoring means for correctively adjusting the fountain to control the rate of water feed to the form roller and plate during normal printing, the fountain being sufficiently upstream in the water feed path so that there is a delay between the making of an adjustment at the fountain and a resulting change in film thickness at the plate, second water flow control means in the form of means for cyclically engaging and disengaging the form roller from the plate to control the feeding of water to the plate, means operated incident to the disengagement of the blanket cylinder from the plate cylinder and the impression cylinder for disabling the first flow control means and for connecting the second flow control means to the monitoring means, with the relatively rapid response of the second flow control means as compared to the first flow control means serving to promptly limit and maintain a film of predetermined thickness on the plate, and means operated incident to re-engagement of the blanket cylinder for disabling the second flow control means and for restoring control of film thickness to the first flow control means.

4. The combination as claimed in claim 2 in which the means for adjusting the fountain to control the water feed rate to the form roller and plate during normal printing is in the form of a fountain roller having an associated variable speed drive motor.

5. The combination as claimed in claim 3 in which means are provided coextensively responsive to disablement of the first flow control means for maintaining the adjustment of the fountain to that which was in effect just prior to the interruption of normal printing.

6. The combination as claimed in claim 3 in which a time delay device is interposed ahead of the fountain adjusting means to delay the making of a change in adjustment of the fountain adjusting means for a predetermined delay interval following re-engagement of the blanket cylinder with the plate cylinder.

7. The combination as claimed in claim 2 in which means are provided for cutting off the flow of the film of ink to the plate in response to throw-off of the blanket cylinder and for restoring flow of the ink film when the blanket cylinder is re-engaged with the plate cylinder.

8. In a lithographic printing press, the combination comprising a plate cylinder, a blanket cylinder, and an impression cylinder, means for applying a film of ink to the plate on the plate cylinder, a water feed system for applying a film of water to the plate on the plate cylinder, means for throwing off the blanket cylinder to interrupt normal printing, the water feed system including a fountain and a form roller with at least one feed roller interposed therebetween, the fountain having a fountain roller and a variable speed driving motor, means for monitoring the thickness of the water film on the plate, means for coupling the monitoring means to the variable speed driving motor for causing a corrective change in the speed of the fountain roller upon variations in the thickness of the water film tending to establish a water film of predetermined thickness, alternate means for controlling water feed including means for oscillating the water form roller toward and away from the plate on the plate cylinder, means responsive to throw off the blanket cylinder for disabling the fountain motor speed adjusting means and for coupling the thickness monitoring means to the oscillating means for corrective control of the latter for prompt limitation of the film to said predetermined thickness, and means responsive to the re-engagement of the blanket cylinder with the plate cylinder for disabling the oscillating means and for restoring control of film thickness to the fountain motor speed adjusting means, the throw-off means being so constructed and arranged that, upon re-engagement of the blanket cylinder, contact takes place first between the blanket cylinder and the plate cylinder so that the blanket is inked up prior to engagement of the blanket with the impression cylinder.

9. In a lithographic printing press, the combination comprising a press drive, a plate cylinder, a blanket cylinder, and an impression cylinder, means including a plurality of ink feed rollers and an ink form roller for feeding a film of ink to the plate on the plate cylinder, a water feed system for applying a film of water to the plate on the plate cylinder, the water feed system including a fountain and a water form roller with at least one water feed roller interposed between, means for throwing off the blanket cylinder to interrupt normal printing, a normal water flow control means in the form of means for correctively adjusting the fountain for automatic control of water feed rate to the plate during normal printing, the fountain roller being sufficiently upstream in the water feed path so that there is a delay between the making of an adjustment at the fountain and the resulting change in film thickness at the plate, an alternate water flow control means in the form of means for oscillating the water form roller into and out of engagement with the plate, means actuated upon the throwing off of the blanket cylinder for promptly disengaging both the ink and water form rollers from the plate cylinder and for energizing the oscillating means, and means actuated upon reengagement of the blanket cylinder with the plate cylinder for re-engaging the form rollers and for disabling the oscillating means.

10. The combination as claimed in claim 9 in which a clutch is interposed between the press drive and the ink feed rollers with means for disengaging the clutch upon throwing off the blanket cylinder.

11. In a lithographic printing press, the combination comprising a press drive, a plate cylinder, a blanket cylinder, and an impression cylinder, an inking system including a form roller for applying a film of ink to the plate on the plate cylinder, means for temporarily disengaging the ink form roller from the plate, a water feed system for applying a film of water to the plate on the plate cylinder, the water feed system including a fountain and a form roller with at least one feed roller interposed therebetween, normal water flow control means in the form of means including film thickness control means for correctively adjusting the fountain to control the water feed rate, alternate water flow control means in the form of means for temporarily disengaging the water form roller from the plate, means for relatively shifting the blanket cylinder to separate the blanket cylinder from the plate and impression cylinders, means responsive to separation of the cylinders for (a) disabling the normal water flow control means and (b) disengaging the form rollers from the plate so as to promptly cut off transfer of ink and water to the plate and responsive to re-engagement of the blanket cylinder and plate cylinder for (1) reestablishing the normal water flow control means and (2) re-engaging the form rollers with the plate, said shifting means being so constructed and arranged that, upon re-engagement of the cylinders, contact takes place first between the blanket cylinder and the plate cylinder so that the blanket is inked up prior to engagement of the blanket with the impression cylinder, and means coupled to the shifting means for prolonging the initial contact between the blanket cylinder and plate cylinder to insure at least several revolutions thereof prior to engagement of the blanket with the impression cylinder.

12. In a lithographic printing press, the combination comprising a press drive, a plate cylinder, a blanket cylinder, and an impression cylinder, an ink feed system including a plurality of ink feed rollers and a form roller, means including a clutch for coupling the press drive to the ink feed rollers, a water feed system for applying a film of water to the plate on the plate cylinder, the water system including a fountain and a form roller with at least one feed roller interposed therebetween, means for monitoring the thickness of the water film on the plate and for providing an output signal in accordance with film thickness, means responsive to the monitoring means for correctively adjusting the fountain to control the water feed rate during normal printing, alternate water control means including means for oscillating the water form roller into and out of contact with the plate, means for shifting the blanket cylinder relatively out of contact with the plate cylinder and the impression cylinder, means responsive to the shifting means and operated incident to interruption of normal printing for disabling the fountain adjusting means and for coupling the monitoring means to the oscillating means for promptly cutting off the flow of water to the printing plate and for maintaining thereon a water film of predetermined thickness, means operated incident to the interruption of normal printing for disengaging the clutch thereby to cut off transfer of ink by the ink feed rollers, the shifting means being so constructed and arranged that upon resumption of normal printing the blanket cylinder engages the plate cylinder for inking up of the blanket prior to engagement between the blanket and the impression cylinder, and means for re-engaging the clutch and for restoring control of the water film to the fountain adjusting means.

13. In a lithographic printing press, the combination comprising a press drive, a plate cylinder, a blanket cylinder, and an impression cylinder, an ink feed system including an ink fountain as well as ink feed rolls and a disengageable ink form roller, means including a clutch for coupling the ink feed rolls to the press drive, a water feed system including a water fountain with at least one water feed roller and a water form roller, means for constantly monitoring the thickness of the water film on the plate and for producing an output signal, means responsive to the output signal for correctively adjusting the water fountain so that a film of predetermined thickness tends to be produced on the plate, auxiliary water control means for oscillating the water form roller into and out of contact with the plate, means for throwing off the blanket cylinder to interrupt normal printing, means responsive to throw-off for (a) disabling the water fountain adjusting means, (b) connecting the monitoring means to the oscillating means for promptly cutting off flow of water to the plate and for subsequently maintaining a film of predetermined thickness on the plate, (c) disengaging the clutch for stopping rotation of the ink feed rolls, and (d) disengaging the ink form roller thereby to promptly interrupt feeding of further ink to the plate, and means responsive to re-engagement of the blanket cylinder for (1) restoring control of water film to the water fountain adjusting means, (2) disabling the water form roller oscillating means, (3) re-engaging the clutch, and (4) re-engaging the ink form roller to resume feeding of ink to the plate, the blanket cylinder throw-off means being so constructed and arranged that upon re-engagement of the blanket cylinder the blanket makes initial contact with the plate for re-inking of the blanket prior to re-engagement of the blanket cylinder with the impression cylinder.

14. In a lithographic press, the combination comprising a press drive, a plate cylinder, a blanket cylinder, and an impression cylinder, an inking system including ink feed rolls coupled to the press drive and an ink form roller for applying a film of ink to the plate cylinder, the ink form roller being disengageable from the plate, a water feed system including a fountain with at least one feed roller and a water form roller for applying a film of water to the plate on the plate cylinder, an eccentric mount for the blanket cylinder, a linkage coupled to the eccentric mount, the eccentric mount being so constructed that the blanket cylinder is thrown off from the impression cylinder and then from the plate cylinder in succession upon movement of the linkage in one direction and re-engaged with the plate cylinder and impression cylinder in succession upon movement of the linkage in the opposite direction, an operating arm coupled to the linkage, means operative incident to throw-off for unclutching the ink feed rolls from the press drive, means operated incident to throw-off for disengaging the ink form roller to cut off flow of ink to the plate, means operated following throw-off for cleaning the blanket, means operated re-engagement of the blanket cylinder for reclutching the ink feed rolls and re-engaging the ink form roller for resumption of ink feed, and means for insuring that the blanket is in initial engagement with the plate for a sufficient number of rotative cycles to insure inking up of the blanket by the plate so that the blanket is in printing readiness prior to engagement of the blanket with the impression cylinder.

15. In a lithographic press, the combination comprising a press drive, a plate cylinder, a blanket cylinder, and an impression cylinder, an ink feed system including a plurality of ink feed rolls and an ink form roller, a clutch for coupling the ink feed rolls to the press drive, a water feed system including a water fountain with at least one water feed roller and a water form roller, means for monitoring the thickness of the water film on the plate and for producing an output signal in accordance therewith, means for correctively adjusting the water fountain in accordance with the signal from the monitoring means so that the thickness of water film tends to remain constant at a predetermined level, auxiliary water control means in the form of means for oscillating the water form roller into and out of contact with the printing plate, means for throwing off the blanket cylinder to interrupt normal printing, means responsive to throw-off for disengaging the clutch to terminate the feeding of ink to the plate, means responsive to throw-off for controllingly connecting the monitoring means with the oscillating means to promptly cut off the feeding of water to the plate and for thereafter maintaining a water film of predetermined thickness on the plate, means for cleaning the blanket following throw-off, a tackiness detector for monitoring the tackiness of the ink on the ink feed rolls, means including a solvent sprayer for spraying solvent on the ink feed rolls, means operated following the cleaning of the blanket and coupled to the tackiness detector for energizing the solvent sprayer upon loss of tackiness, means for re-engaging the blanket cylinder with the plate cylinder for reinking of the blanket by the plate prior to engagement of the blanket with the impression cylinder, and means operated incident to re-engagement of the blanket cylinder with the plate and impression cylinders for (a) engaging the clutch, (b) disabling the oscillating means for the water form roller, and (c) reconnecting the monitoring means to the water fountain for subsequent control of water film thickness.

16. In a lithographic press, the combination comprising a press drive, a plate cylinder, a blanket cylinder, and an impression cylinder, an ink feed system including a plurality of ink feed rolls and an ink form roller, a clutch for coupling the ink feed rolls to the press drive, a water feed system including a water fountain with at least one water feed roller and a water form roller, means for monitoring the thickness of the water film on the plate and for producing an output signal in accordance therewith, means for correctively adjusting the water fountain in accordance with the signal from the monitoring means so that the thickness of water film tends to remain constant at a predetermined level, auxiliary water control means in the form of means for oscillating the water form roller into and out of contact with the printing plate, means for throwing off the blanket cylinder to interrupt normal printing, means responsive to throw-off for (a) disengaging the clutch and ink form roller to promptly cut off feeding of ink to the plate and for (b) controllingly connecting the monitoring means with the oscillating means to promptly cut off the feeding of water to the plate and for thereafter maintaining a water film of predetermined thickness on the plate, means for cleaning the blanket following throw-off, means including a solvent sprayer for spraying solvent on the ink feed rolls, means operated following the cleaning of the blanket for energizing the solvent sprayer, means for re-engaging the blanket cylinder with the plate cylinder for re-inking of the blanket prior to engagement of the blanket with the impression cylinder, and means operated incident to re-engagement of the blanket cylinder with the plate and impression cylinders for (1) re-engaging the clutch and ink form roller, and (2) disconnecting the monitoring means from the oscillating means for reestablishing control of the water fountain by the monitoring means.

17. In a lithographic press, the combination comprising a press drive, a plate cylinder, a blanket cylinder, and an impression cylinder, an inking system including ink feed rolls and an ink form roller for applying a film of ink to the plate on the plate cylinder, a clutch for coupling the ink feed rolls to the press drive, means for disengaging the ink form roller from the plate cylinder, a water feed system including a fountain with at least one feed roller and a water form roller for applying film of water to the plate on the plate cylinder, means for oscillating the water form roller into and out of contact with the plate cylinder, means for monitoring the thickness of the water film on the plate cylinder for corrective control of the oscillating means, an eccentric mount for the blanket cylinder, a linkage coupled to the eccentric amount for moving the eccentric mount to a first position in which the blanket cylinder is thrown off from the impression and plate cylinders, means operative incident to throw-off for disengaging the clutch and ink form roller and for energizing the oscillating means for prompt cutting off of flow ink and water to the plate followed by maintenance of a film of water on the plate, means operated following throw-off for cleaning the blanket, the eccentric mount being so constructed and arranged that the blanket cylinder is, upon movement of the eccentric mount to a second position, engaged by the plate cylinder and upon continued movement of the mount to a third position additionally engaged with the impression cylinder, switch means operated upon movement of the eccentric mount from its first position to its second position for disabling the oscillating means and for re-engaging the clutch and re-engaging the ink form roller for resumption of ink feed to the blanket, means for insuring that the blanket cylinder is in engagement with the plate cylinder for a sufficient number of rotative cycles to insure inking up of the blanket by the plate so that the blanket is in printing readiness for engagement of the blanket cylinder with the impression cylinder as the eccentric mount is moved into its third position.

* * * * *